US010504390B2

(12) United States Patent
Howell et al.

(10) Patent No.: US 10,504,390 B2
(45) Date of Patent: Dec. 10, 2019

(54) SAFETY SIGN WITH EXTENSION ARM

(71) Applicants: Byron H. Howell, East St. Louis, IL (US); Voris L. Spicer, Fairview Heights, IL (US)

(72) Inventors: Byron H. Howell, East St. Louis, IL (US); Voris L. Spicer, Fairview Heights, IL (US)

( * ) Notice: Subject to any disclaimer, the term of this patent is extended or adjusted under 35 U.S.C. 154(b) by 0 days.

(21) Appl. No.: 15/898,423

(22) Filed: Feb. 17, 2018

(65) Prior Publication Data

US 2018/0240381 A1 Aug. 23, 2018

Related U.S. Application Data

(60) Provisional application No. 62/460,465, filed on Feb. 17, 2017.

(51) Int. Cl.
*G09F 15/00* (2006.01)

(52) U.S. Cl.
CPC ..... *G09F 15/0062* (2013.01)

(58) Field of Classification Search
CPC ..... G09F 15/0062; G09F 13/16; B60Q 1/08; B60Q 1/52; B60Q 2300/45; E01F 9/654; E01F 9/688; E01F 9/962; E01F 13/02
See application file for complete search history.

(56) References Cited

U.S. PATENT DOCUMENTS 239,437 A 3/1881 Bube
1,374,471 A * 4/1921 Reynard ..... G08G 1/096716 116/173
2,515,622 A 7/1950 Wild
2,633,641 A 4/1953 Fleming
3,132,628 A * 5/1964 Gehlsen ..... G08B 5/02 116/319
D249,252 S 9/1978 Gatof
4,253,260 A 3/1981 Maza et al.
D264,565 S 5/1982 Medeiros
4,624,210 A * 11/1986 Glass ..... E01F 9/688 116/63 P
4,796,369 A 1/1989 Hamann
4,977,697 A 12/1990 Genick
(Continued)

OTHER PUBLICATIONS

Rubbermaid Commercial Products, Catalog RCP1041, Revised Nov. 2016, pp. 1-4, 206-211, rear cover.
(Continued)

*Primary Examiner* — Cassandra Davis
(74) *Attorney, Agent, or Firm* — Sandberg Phoenix & von Gontard, P.C.

(57) ABSTRACT

An extension arm connected to a panel of a safety sign is moveable between a first position extending laterally of the panel a distance at least equal to the maximum width of the panel and a second position. In one embodiment the arm is an assembly held to a handhold of the safety sign. In some embodiments the arm is hinged for folding in the manner of a carpenter's rule. In some embodiments the arm is rotatable between an operative laterally extending, generally horizontal, position and a stowed position. In other embodiments, an A-frame safety sign has a removable arm attached to it, the removable arm when attached being movable to a position extending outward a distance at least equal to the maximum width of the panel.

12 Claims, 2 Drawing Sheets

(56) References Cited

U.S. PATENT DOCUMENTS

| | | | | |
|---|---|---|---|---|
| 5,009,541 | A | 4/1991 | Thurston | |
| 5,621,992 | A | 4/1997 | Mandell et al. | |
| 6,131,320 | A | 10/2000 | Eberle et al. | |
| 6,948,446 | B2 | 9/2005 | Greves | |
| 7,013,590 | B1 | 3/2006 | Bell et al. | |
| 7,057,530 | B2 | 6/2006 | Young | |
| 7,107,713 | B2 | 9/2006 | Simson et al. | |
| 7,111,408 | B2 | 9/2006 | Critelli et al. | |
| 7,562,477 | B2 | 7/2009 | Kurple et al. | |
| 7,748,151 | B2 | 7/2010 | Glass | |
| 8,782,914 | B1 | 7/2014 | DeLuca | |
| D787,969 | S | 5/2017 | Tsui | |
| 2003/0000096 | A1 | 1/2003 | Wang | |
| 2004/0188664 | A1* | 9/2004 | Perelli | E01F 13/02 256/64 |

OTHER PUBLICATIONS

Delamo Mfg., Inc., catalog RR160925, (2016), pp. 1-4, 25, rear cover.

Home Depot, model PSE-0184, Plastic Multi-Lingual Yellow 25 in.×12 in. Caution Wet Floor Sign 2-Sided, available online at https://www.homedepot.com/p/Plastic-Multi-Lingual-Yellow-25-in-x-12-in-Caution-Wet-Floor-Sign-2-Sided-PSE-0184/300050028, before Feb. 9, 2018.

* cited by examiner

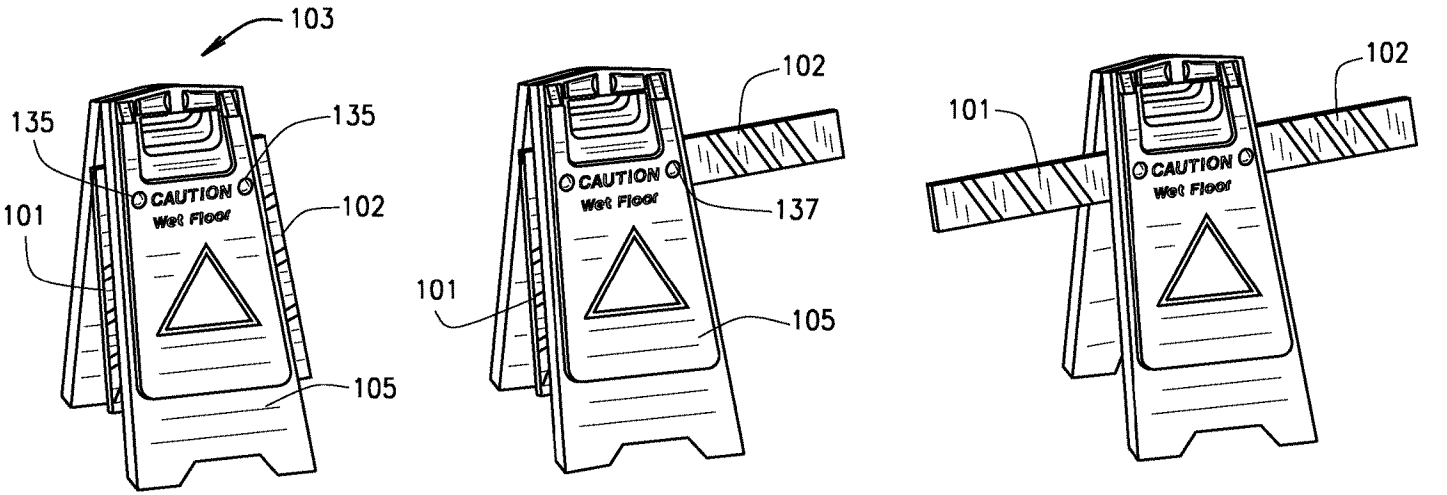
FIG. 5
FIG. 6
FIG. 7
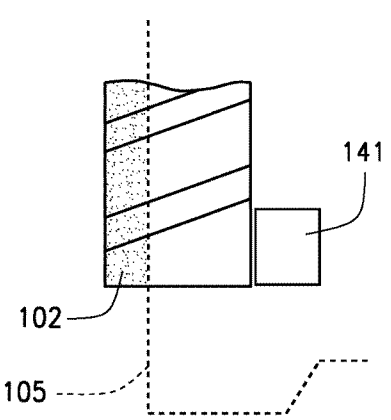
FIG. 8
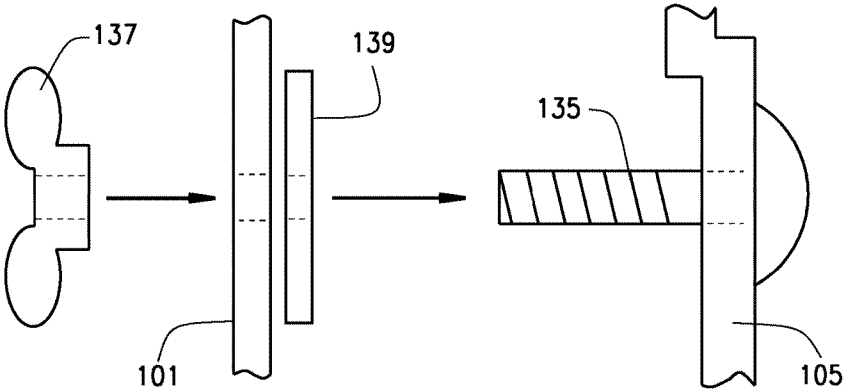
FIG. 9

SAFETY SIGN WITH EXTENSION ARM

CROSS-REFERENCE TO RELATED APPLICATIONS

This application claims the benefit of U.S. Provisional Application No. 62/460,465, filed Feb. 17, 2017, the disclosure of which is hereby incorporated by reference herein.

STATEMENT REGARDING FEDERALLY SPONSORED RESEARCH

Not applicable.

BACKGROUND OF THE INVENTION

This invention relates to warning signs, and in particular to portable, free-standing safety signs which are placed on a floor to warn of temporary dangers and closures, such as wet floors, spills, rest room closures for cleaning, and wet paint.

Free-standing signs warning that a floor is wet or that a particular area should be avoided are well known. One common form of such "warning" or "safety" signs is an A-frame sign having two flat panels hinged together at their upper ends. Examples of such signs are shown in Maza et al., U.S. Pat. No. 4,253,260, Glass, U.S. Pat. No. 4,624,210, Hamann, U.S. Pat. No. 4,796,369, Genick, U.S. Pat. No. 4,977,697, Thurston, U.S. Pat. No. 5,009,541, Mandell, et al., U.S. Pat. No. 5,621,992, Eberle et al., U.S. Pat. No. 6,131,320, Bell et al., U.S. Pat. No. 7,013,590, Young, U.S. Pat. No. 7,057,530, Kurple, et al., U.S. Pat. No. 7,562,477, Glass, U.S. Pat. No. 7,748,151, and Tsui, U.S. Pat. No. D787,969. Although such signs were originally made of wood or metal, they are today most frequently molded of plastic. Other such warning or safety signs are known, including a single panel having a floor-engaging foot, sold by Rubbermaid Commercial Products, LLC, Winchester, Va., USA as its model FG9S0925. Still other such signs include cones, pyramids, and other round, octagonal, or four-sided structures, but the present invention is not concerned with these.

Safety signs generally range in height from about 22" to about 40", usually about 26". They have a maximum width of about 10" to 13". A common safety sign has a width at its top of about 8" to 9", a width at its bottom of about 12", an open or standing depth of about 15" to 16", and a standing height of about 23" to 24".

Safety signs are limited by their size to protecting a relatively small area. If a doorway or a hallway is to be closed, more than one sign is needed to block or impede passage. Closing a larger area, such as a hallway, is sometimes accomplished by stringing tape between two free-standing signs, such as cones, but this requires a substantial amount of labor as well as the use of multiple signs, a tape reel, and mountings on each sign for the tape and its reel.

BRIEF SUMMARY OF THE INVENTION

Briefly stated, the invention relates to free-standing safety signs of the type comprising a broad, rigid panel. The safety sign is preferably an A-frame type, with two panels hinged to each other at or near their tops. The panel is preferably open on two sides. In accordance with the invention, an attachment is provided which extends the sign in at least one lateral direction. The attachment is preferably in the form of an arm. The arm may be formed of any rigid, light-weight material. Examples are polystyrene or polyurethane foam, plastic-coated fiberboard, and molded plastic. The arm preferably is formed of sheet material. The arm preferably has a length several times (illustratively three to fifteen times) its height, and a height many times (illustratively five to thirty times) its thickness. The extension preferably extends a distance at least equal to a maximum width of the panel, illustratively one to three times its width.

The arm in some embodiments is detachably attached to the safety sign. In other embodiments, the arm is movably, preferably rotatably, mounted to the safety sign. In some embodiments, the arm folds to increase and decrease the length of the arm. In other embodiments, it telescopes to increase or decrease its length.

The arm preferably extends generally horizontally beyond the panel a distance greater than the width of the panel. In an embodiment, the arm is configured to extend alternatively a distance at least twice the width of the panel on one side, or a distance greater than the panel width beyond both sides of the panel.

In one embodiment, the arm is rotatably attached to a face of the panel. In an embodiment, the rotatable attachment is by a bolt. In other embodiments, the arm is attached by a folding rule joint which has stops holding the arm alternatively in extended and retracted positions.

In other embodiments, the arm includes a clamp to mount it to the top of the safety sign. In embodiments, the clamp is a split elastomeric hose. In other embodiments, the clamp is a strap. In other embodiments, the clamp is integrally molded into a mounting piece in the manner of Hamann, U.S. Pat. No. 4,796,369.

In other embodiments, the arm is mounted to a vertically-extending spine molded in one panel, similar to the cross-bar 18 of Mandell et al., U.S. Pat. No. 5,621,992. A commercial version of this construction is sold by Rubbermaid Commercial Products, LLC, Winchester, Va., USA as its model FG611478 and in a more conventional A-frame construction as its model FG611278 (Catalog RCP1041, rev. 11/16, p. 209).

In embodiments, the arm folds and unfolds to control its length. In embodiments, the arm is made of sections slidably mounted to each other.

Signs with extensions per se are known, as shown for example in Hamann, U.S. Pat. No. 4,796,369, Greves, U.S. Pat. No. 6,948,446, Simson et al., U.S. Pat. No. 7,107,713, and Medeiros, U.S. Pat. No. Des. 264,565, but none of these addresses the same problem and none incorporates a similar construction.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification:

FIG. 5 is a view in perspective of an A-frame safety sign having extension arms pivotably connected to it in accordance with another illustrative embodiment of the present invention.

FIG. 6 is a view in perspective of the safety sign of FIG. 5 with one of its arms extended laterally.

FIG. 7 is a view in perspective of the safety sign of FIGS. 5 and 6, with both arms extended laterally.

FIG. 8 is a view in rear elevation of one panel of the safety sign of FIGS. 5-7, showing the interaction of a folded arm with a stop mounted to the inside of the panel.

FIG. 9 is a fragmentary exploded view in side elevation of one panel of the safety sign of FIGS. 5-7, showing attachment of the arm to the panel.

Corresponding reference numerals indicate corresponding parts throughout the several figures of the drawings.

DESCRIPTION OF THE PREFERRED EMBODIMENTS

Figure 1:
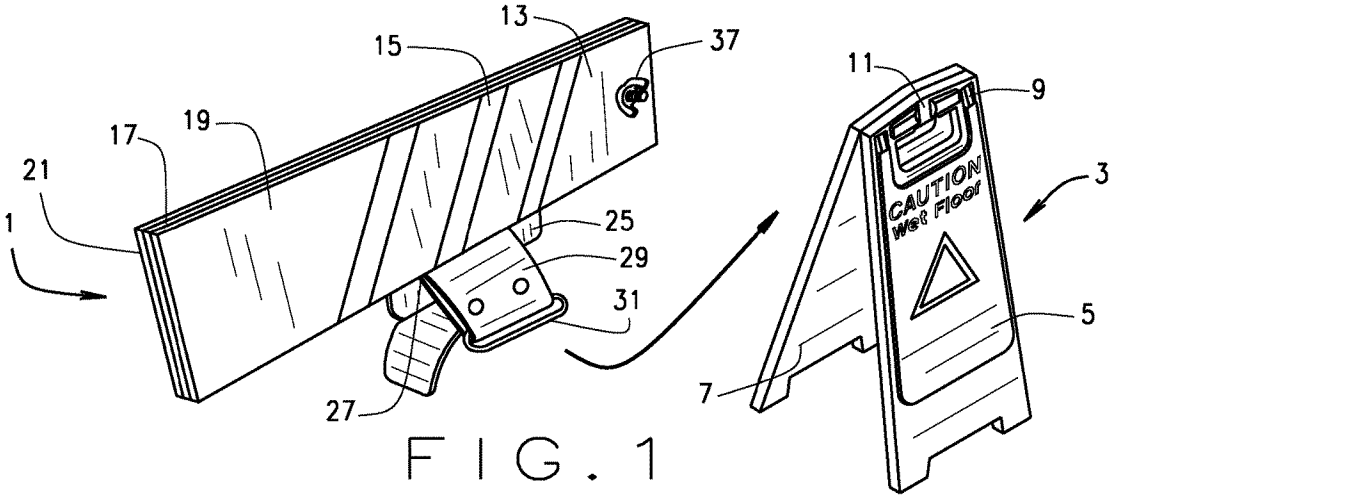
FIG. 1 is a view in perspective of an A-frame safety sign and an extension arm for attachment to it in accordance with one illustrative embodiment of the present invention.

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

FIGS. 1-4 show one illustrative embodiment of the invention. In accordance with this embodiment, an extension arm 1 is carried by an A-frame safety sign 3. The sign 3 may be, illustratively, a sign sold by Delamo Manufacturing Inc., Montebello, Calif., as its model 8008 (shown in its Catalog RR160925, 2016, p. 25).

The safety sign 3 is per se well known and comprises a first panel 5 and a second panel 7. At their upper ends, the panels 5 and 7 hinged together at 9 and form a central handhold 11. The panels 5 and 7 are molded from an appropriate plastic and may be identical, or may have the handhold 11 formed in only one of the panels. The hinge 9 is designed to limit opening of the panels to a desired angle, typically about 30° to about 40°, nominally 35°. The panels are typically formed with an embossed central area and/or are partially ribbed for strength. The panels typically have a greatest width of about 10"-13" at their lower, footed, end, and a width of about 8"-11" at their upper ends below the handhold 11. Each panel has a height of about 24"-28", nominally 26". In other embodiments, the panels are taller, ranging from 32-40" in height.

The extension arm 1 is light enough not to tip the safety sign 3 even when fully extended. The arm 1 is illustratively made of plastic foam having calendered or coated broad faces 13. The faces 13 may have high-visibility colors or designs such as diagonal stripes 15 imprinted on them. The arm is illustratively made of a closed-cell plastic foam material such as high density polystyrene foam having a paper or film facing or a closed cell polyvinylchloride material, although other sheet or formed materials having the required stiffness and light weight may also be used.

The illustrative arm 1 is an assembly made in three sections: a central section 17, a first outer section 19, and a second outer section 21. Each illustrative section has a thickness of 0.25", a length of 18", and a height of 3".

A downwardly extending ear 25 at the central portion of the central arm section 17 includes a slot 27 for a Velcro® hook-and-loop cinch strap 29. The cinch strap 29 is wrapped through the hand-hold 11 of the front and rear panels 5 and 7, drawn through ring 31, and pressed tight. The ear 25 presses against the handhold 11 and holds the arm 1 upright.

The central arm section 17 has bolt holes 33 spaced a short distance from each of its ends. Outer arm segments 19 and 21 have similar bolt holes near their inner ends. Two bolts 35 extend through the bolt holes in opposite directions and, with wing nuts 37, hold the outer arm sections frictionally to the central section 17 in a desired position. The outer arm sections 19 and 21 may be pivoted out and held in place by tightening wingnuts 37 on bolts 35. Because the bolts are oriented so that their heads engage the opposing outer section and the wing nuts are exposed when the arm 1 is folded shut, the arm sections lie relatively flat against each other when they are folded shut.

Figure 4:
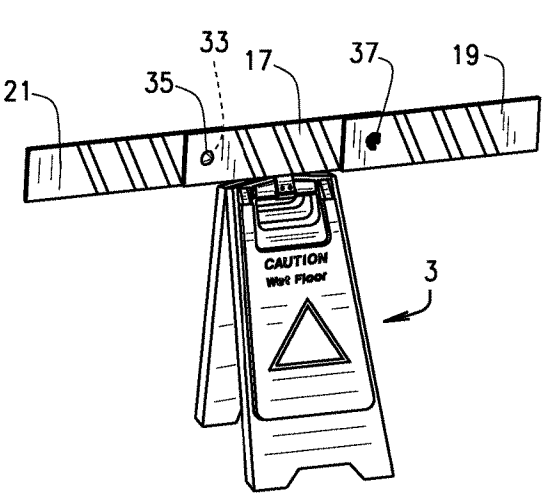
FIG. 4 is a view in perspective of the safety sign and extension arm of FIGS. 1-3, with the arm unfolded on both lateral sides of the sign.
Figure 3:
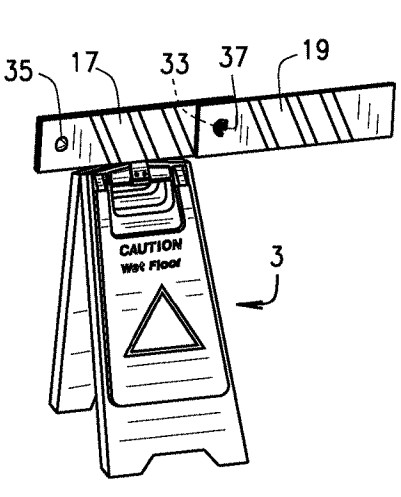
FIG. 3 is a view in perspective of the A-frame safety sign of FIGS. 1 and 2, showing the extension arm unfolded on one lateral side of the sign.
Figure 2:
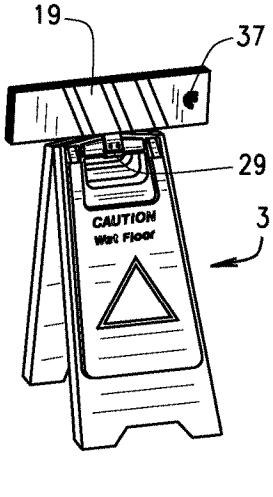
FIG. 2 is a view in front elevation of the sign and extension arm of FIG. 1, with the arm attached to a carrying handle (handhold) of the sign.

As shown in FIG. 2, the arm assembly 1 may remain attached to the sign 3 with the outer sections folded in during normal use of the sign 3. When traffic around one side of the sign 3 is to be limited, one outer section 19 may be folded out and its bolt 35 tightened as shown in FIG. 3. When traffic around both sides is to be limited, both outer sections 19 and 21 are folded out as shown in FIG. 4.

When the safety sign 3 is to be moved, it can be folded flat and carried without removing the arm, as shown in FIG. 2, or the extension arm can be removed and carried separately.

It will be understood that rather than a cinch belt, the arm assembly 1 may be held to the handhold in other ways. For example, a split elastomeric tube attached to the central section 17 may be pressed over the handhold, or a molded clip may be attached to, or formed integrally with, the central section 17.

It will be further understood that rather than using bolts, the arm sections may be held to each other using a spring-loaded pivot of the sort used in a standard folding ruler (carpenter's rule) such as the mechanisms shown in Wild, U.S. Pat. No. 2,515,622 or Fleming, U.S. Pat. No. 2,633,641. The segments may be held at angles other than 180° by the use of multiple stops, such as are shown in Bube, U.S. Pat. No. 239,437, Critelli, et al., U.S. Pat. No. 7,111,408, DeLuca, U.S. Pat. No. 8,782,914, or Wang, U.S. Published Application No. US 2003/0000096.

It will also be understood that additional arm segments may be added, which may fold and unfold to adjust the length of the arm 1. The length of the arms may also be adjusted by making sections slidable with respect to each other, as by telescoping square tubular or C-shaped segments.

Another embodiment is shown in FIGS. 5-9. In this embodiment, extension arms 101 and 102 are pivoted at their inner portions to a front panel 105 of a wet sign 103, through holes formed in the panel 105. In this illustrative embodiment, the pivot is a bolt 135, rubber spacer washer 139, and wingnut 137. When the wingnuts 137 are loosened, the arms fall against stops 141 adhered to the back of the panel 105. The arms 101 and 102 add very little to the thickness of the wet sign 103, even when it is folded to its collapsed storage position. Again, the arms 101 and 102 could be permanently attached to the sign 103 using a spring-loaded folding rule joint, and the arms 101 and 102 could be made of foldable or telescoping sections.

As various changes could be made in the above constructions without departing from the scope of the invention, it is intended that all matter contained in the above description or shown in the accompanying drawings shall be interpreted as illustrative and not in a limiting sense. For example, the safety sign could be a single panel supported by a foot or feet. The extension arm or arms can be made of different materials, preferably light weight, rigid, durable materials. A single arm may be utilized. Especially when the sign includes identical panels hinged together, the second arm may be attached to the same side of the other panel of an A-frame safety sign, so that, when the panels are hinged together, the arms extend in opposite directions. The arms may be pivotably mounted to the front face of the panel rather than the rear; this arrangement may permit the panels of an A-frame sign to close flush. Arms may be attached by the used of hook-and-loop fasteners attached to the inner ends of the arms and to faces of the signs or to the handhold of the sign. The various features of each embodiment may be utilized in the other embodiments. These variations are merely illustrative.

All patents, published applications, and literature mentioned herein are hereby incorporated by reference.

The invention claimed is:

1. In combination, an A-frame safety sign having a first panel and a second panel hinged together at an upper portion of each panel by two spaced apart hinges and a handhold between the hinges, an arm extending laterally beyond the panels by at least the width of the panels, and a connector holding the arm to the handhold, the arm being removably clamped to the handhold.

2. The combination of claim 1 wherein the arm is clamped by a strap.

3. The combination of claim 1 wherein the safety sign has a height of about 22" to about 40", a maximum width of about 10" to about 13", and a width near the top of the sign of about 7" to about 11".

4. The combination of claim 3 wherein the arm has a height of 1" to 8" and a length several times greater than its height.

5. The combination of claim 3 wherein the first panel and the second panel are molded of plastic.

6. The combination of claim 5 wherein the hinge limits opening of the panels beyond about forty degrees.

7. The combination of claim 1 wherein the arm is formed in multiple segments, a first segment carrying the connector, the connector being a clamp sized to engage a first side of the handhold and a second side of the handhold, and a second segment being moveable relative to the first segment.

8. The combination of claim 7 wherein the segments are pivoted to each other.

9. The combination of claim 8 wherein the segments are pivoted by a bolt.

10. The combination of claim 7 wherein the segments are pivoted by a spring-loaded pivot.

11. The combination of claim 7 comprising a third segment.

12. The combination of claim 11 wherein the third segment is pivoted to the first segment.

* * * * *